US009160045B2

(12) United States Patent
Hampel et al.

(10) Patent No.: US 9,160,045 B2
(45) Date of Patent: Oct. 13, 2015

(54) RECONFIGURABLE BANDPASS FILTER BASED ON A PLANAR COMBLINE FILTER COMPRISING VARACTOR DIODES

(75) Inventors: Hermann Hampel, Grosshabersdorf (DE); Ulrich Berold, Nuremberg (DE); Christoph Reck, Erlangen (DE); Lorenz-Peter Schmidt, Hessdorf (DE); Ralph Trommer, Grosshabersdorf (DE)

(73) Assignee: iAd Gesellschaft für Informatik, Automatisierung und Datenverarbeitung mbH, Grosshabersdorf (DE)

( * ) Notice: Subject to any disclaimer, the term of this patent is extended or adjusted under 35 U.S.C. 154(b) by 260 days.

(21) Appl. No.: 13/418,935

(22) Filed: Mar. 13, 2012

(65) Prior Publication Data

US 2013/0063228 A1 Mar. 14, 2013

(30) Foreign Application Priority Data

Sep. 14, 2011 (DE) ..... 20 2011 105 662 U

(51) Int. Cl.
*H01P 1/203* (2006.01)
*H01P 7/08* (2006.01)

(52) U.S. Cl.
CPC ..... *H01P 1/20336* (2013.01); *H01P 1/20327* (2013.01); *H01P 1/20381* (2013.01); *H01P 7/082* (2013.01)

(58) Field of Classification Search
CPC ..... H01P 1/20336; H01P 1/20372; H01P 1/20381; H01P 7/088
USPC ..... 333/204, 205, 235
See application file for complete search history.

(56) References Cited

U.S. PATENT DOCUMENTS

| | | | | | |
|---|---|---|---|---|---|
| 4,156,211 | A * | 5/1979 | Buswell et al. | ..... | 331/117 D |
| 5,227,748 | A * | 7/1993 | Sroka | ..... | 333/207 |
| 5,616,538 | A * | 4/1997 | Hey-Shipton et al. | ..... | 505/210 |
| 6,130,189 | A * | 10/2000 | Matthaei | ..... | 505/210 |
| 6,577,211 | B1 * | 6/2003 | Tsujiguchi | ..... | 333/204 |

(Continued)

FOREIGN PATENT DOCUMENTS

| | | | | |
|---|---|---|---|---|
| DE | 10344167 B3 | | 12/2004 | |
| DE | 602005001762 T2 | | 12/2007 | |
| JP | WO 2011/033573 | * | 3/2011 | ..... H01P 1/203 |

OTHER PUBLICATIONS

Kawaguchi et al, English translation of WO 2011/033573, Mar. 2011, WIPO.*

(Continued)

*Primary Examiner* — Robert Pascal
*Assistant Examiner* — Gerald Stevens
(74) *Attorney, Agent, or Firm* — Rankin, Hill & Clark LLP

(57) ABSTRACT

A reconfigurable bandpass filter including at least a tunable planar combline filter including varactor diodes arranged on a carrier board. For automatic calibration of adjustment of blocking voltage during operation, the reconfigurable bandpass filter includes a filter control offering an external abstracted interface. A memory is connected with the filter control. The memory stores calibration data. For approximating of the best possible filter characteristic, the filter control determines, based on memorized data, the best configuration of tuning voltages.

The reconfigurable bandpass filter can be used in the field of secondary radar systems.

3 Claims, 8 Drawing Sheets

(56) References Cited

U.S. PATENT DOCUMENTS

| | | | | |
|---|---|---|---|---|
| 7,902,585 | B2 * | 3/2011 | Larson et al. | 257/312 |
| 8,242,862 | B2 * | 8/2012 | Akale | 333/205 |
| 2004/0183624 | A1 * | 9/2004 | Liang et al. | 333/134 |
| 2005/0094753 | A1 | 5/2005 | Burger | |
| 2005/0095998 | A1 * | 5/2005 | Toncich | 455/129 |
| 2006/0220765 | A1 | 10/2006 | Muller et al. | |
| 2011/0279176 | A1 * | 11/2011 | Oran | 327/553 |

OTHER PUBLICATIONS

Reck, Christoph et al.; "Bandpass Filter with Tunable Bandwidth and Center Frequency based on Varactor Diodes"; German Microwave Week; Mar. 14, 2011.

* cited by examiner

RECONFIGURABLE BANDPASS FILTER BASED ON A PLANAR COMBLINE FILTER COMPRISING VARACTOR DIODES

"Reconfigurable bandpass filter based on a planar combline filter comprising varactor diodes"

PRIOR ART

The invention concerns a reconfigurable bandpass filter based on a planar combline filter comprising varactor diodes.

The vast spreading of increasingly integrated circuits for RF and communication purposes led to a growing application density in popular frequency bands. As a result, channels are more closely neighbored and interference becomes a problem in many scenarios. Especially highly sensitive receivers rely on reconfigurable preselection filters, which were normally realized by switchable filter banks. This technique delivers very good results but it is space consuming and costly and it isn't spectral continuously tunable. In the area of high quality measuring instruments like spectrum analyzer and network analyzer filter based on YIG-materials were used. These requires however a strong magnetic field and have a not negligible energy consumption. This approach is inappropriate for mobile, cheap products that save safe energy.

A good alternative is the application of planar circuits. This makes the concept of loading resonant planar structures by variable capacitances attractive. The resonance of those structures must be solely defined by their electrical length Unfortunately the quality factor Q of line resonators is limited as this is described by A. Gopinath, "Maximum Q-Factor of Microstrip Resonators," IEEE Transactions on Microwave Theory and Techniques, vol. 29, pp. 128-131, 1981. Additional Q restrictions are given by the used varactor elements. Possible candidates are varactor diodes or less well known BST-elements.

Both varactor diodes and BST-elements provide relatively poor Q factors whereas recent varactor diodes based on GaAS reaches four-digit range. Varactors also have the disadvantage that they deliver in high-resistance direction a contribution to noise according to low current. If this is essential must be decided in individual cases. By limitation to Q factor regular band pass filter will have in this technique a relative bandwidth from 5% to 15%. A further reduction of bandwidth requires modified structure and the use of advanced method for tuning.

The goal of a large tuning range limited the selection of appropriate filter structures having a resonant frequency primarily undependable of geometric dimensions. The ground for this limitation is due to the fact that geometric dimensions can only hardly constructed for tuning Nevertheless there are approaches for the use of piezoelectric actuators as this is described by H. Joshi, H. H. Sigmarsson, S. Moon, D. Peroulis, and W. J. Chappell, "High Q Narrow-Band Tunable Filters with Controllable Bandwidth," in IEEE International Microwave Conference, 2009. But such an approach increases enormously the complexity of the module.

For the given environment especially the use of combline-filter is recommended as this is for example described by I. Hunter and J. D. Rhodes, "Electronically Tunabale Microwave Bandpass Filters," in IEEE Transactions on Microwave Theory and Techniques, vol. 9, pp. 1354-1360, 1982. Such a filter is shown in FIG. 2 which comprises inductive coupled and parallel arranged line resonators these could be loaded at the end by varactors. The best mode for coupling is by so called taps, which are a kind of tap in order to obtain a defined tap point as this is for example described by S. Caspi and J. Adelman, "Design of Combline and Interdigital Filters with Tapped-Line Input," in IEEE Transactions on Microwave Theory and Techniques, vol. 36, pp. 759-763, 1988. For reasons of various coupling between all line resonators combline filter are difficult to calculate analytic. Therefore 20 years ago numerical methods for calculation were proposed by C. Denig in "Using Microwave CAD Programs to Analyze Microstrip Interdigital Filters," Microwave Journal, pp. 147-152, 1989. Nevertheless in the literature are approaches to design known, for example by G. Torregrosa-Penalva, G. Lopez-Risueno, and J. I. Alonso, "A Simple Method to Design Wide-Band Electronically Tunable Combline Filters," IEEE Transactions on Microwave Theory and Techniques, vol. 50, pp. 172-177, 2002 the generated geometry could be seen only as a rough start value for further numerical operations by field simulations. Often simplified equivalent circuits are used for the design. The functioning of a combline filter can be seen for example by the equivalent circuit shown in FIG. 3. The line resonators are modeling as parallel resonance circuits their coupling is determined according to an inductance. Of course the model is a severe simplification of the reality. For a more accurate modeling additional couplings between all existing resonant circuits should be considered.

Used in wireless communication systems like mobile communication systems, satellite communication systems or navigation as well radar technology are different kinds of electrical filters for to separate wanted from unwanted signals. These filter elements are for example short circuited lines or coupled resonators. Common to all these variants that the used components are subject to tolerances the resulting filter characteristics distinguishes from the ideal this means calculated filter characteristic. As a rule such filter need to be adapted for obtaining the necessary damping characteristic. Adapting such filters shows that there is no direct reference between the single used elements and the filter characteristic. Adapting such filters may be carried out manually by specialists or automatically. A method for setting of the filter, especially a high frequency electrical bandpass filter comprising a predetermined number of allocated filter elements like short circuited lines or coupled resonators, is known from DE 103 44 167 B3. To propose a method or a device for adapting automatically of an electric filter this means without any active human intervention for designing the ideal filter characteristic an impulse with a predefined center frequency are leaded to said filter and in accordance with the impulse response the individual filter elements are adapted. It should be noted that this uses knowledge in existing a direct context between center frequency of said impulse and of said filter. Especially the filter elements are successively adapted, beginning at the entrance gate of said filter; however a circuit simulator helps to determine the filter damping for fine-tuning By the characteristics of said filter in the frequency range the impulse response can be implemented by a transformer carrying out an inverse Fourier Transformation. The resonant frequency of said combline resonator can be detuned by screws above the open-circuited inner conductor. Coupling can be set by the conductive screws of the aperture. For example the combline bandpass comprises four coupled resonators each have an tuning element. A robot tunes by a data bus said tuning elements automatically. The signals, this means the control commands for controlling the robot, are calculated by a control computer reading out a vectorial network analyzer.

An embodiment is known by DE 60 2005 001762 T2 which shows a micro wave bandpass filter having more coupled resonators including at least one coaxial resonator. To realize a microwave filter having a number of resonators including at least one coaxial resonator providing a sufficient suppression of disturbing pass-bands or pass-bands higher order without affording an additional space said microwave filter comprises a number of resonators including at least one coaxial resonator in the form of a combline resonator. The inner conductor of said combline resonator has a central hole reaching from the upper end of said inner conductor to at least a part of its height. This central hole forms a waveguide section having a cutoff frequency above the pass-band of said filter. The lower area of said filter contains a lossy material which can be a lossy dielectric material for example silicon carbide ceramics or a lossy magnetic material for example resin matrix material filled with magnetic material.

Problem

In view of the above-described bandpass filter, an object of the present invention is to realize a reconfigurable filter whereby tuning in a broad tuning range of center frequency and simultaneously relative low bandwidth of said filter is possible and tuning can be done automatically to reach an optimized filter characteristic.

SUMMARY OF THE INVENTION

This problem can be solved by a reconfigurable bandpass filter comprising at least a tunable planar combline filter comprising varactor diodes arranged on a carrier board, wherein for automatic calibration of adjustment of tuning voltage during operation said reconfigurable bandpass filter comprising a filter control offering an external abstracted interface, wherein a memory is connected with said filter control said memory stores calibration data and wherein said filter control for approximating of the best possible filter characteristic determines based on memorized data (lookup table) the best configuration of tuning voltages.

Advantages of the Invention

Advantage of the invention is that in order of integration of logic to the filter circuit a smart filter is provided, said smart filter realize a simple adaptation to respective application in order taking in account boundary conditions like alteration and temperature during operation insofar an active reaction to a changing scenario as well a better compensation for variability in production and component accuracy is possible

Further Embodiments of the Invention

According to another aspect of the present invention, said combline filter comprises loaded resonant lines shifted on said carrier board against another and wherein said varactor diodes are arranged in anti-serial circuitry and tuning of said varactor diodes is done completely electronic by supplying of said necessary tuning voltage.

This embodiment of the present invention has the advantage that the combline structure according to the invention possesses a large tuning range of the center frequency reaching from 800 MHz to 1300 MHz and additional a low relative bandwidth of nearly 5% in combination with moderate insertion loss between 4 and 5 dB is presented.

According to another aspect of the present invention, a temperature sensor is connected with said filter control.

This embodiment of the present invention has the advantage that calibration can not only be done to the exit but also to digital-analogue-converter because the obtained voltage is also dependent to temperature.

According to another aspect of the present invention, for improvement of said filter characteristic at least a tunable, planar absorption circuit is coupled to a transmission line.

This embodiment of the present invention has the advantage that by purposeful damping of the frequency ranges bordering to the transmission band by planar drain circuits the filter slopes could be improved.

BRIEF DESCRIPTION OF THE DRAWINGS

The accompanying drawings, which are incorporated in and constitute a part of the specification, illustrate presently preferred embodiments of the invention, and together with the general description given above and the detailed description of the embodiments given below, serve to explain the principles of an aspect of the invention, where.

DESCRIPTION OF THE PREFERRED EMBODIMENTS

Referencing to FIG. 1 to FIG. 14 follows a description of different embodiments of reconfigurable bandpass filter FI on basis of planar combline filters KF (especially the combination of modified combline structure comprising varactor diodes V and tunable notch filter SK) which are used at the technical field of secondary radar systems UAT at 900 MHz, 1030 MHz for interrogation/transmission protocol, 1090 MHz for answer/identification codes).

Figure 1:
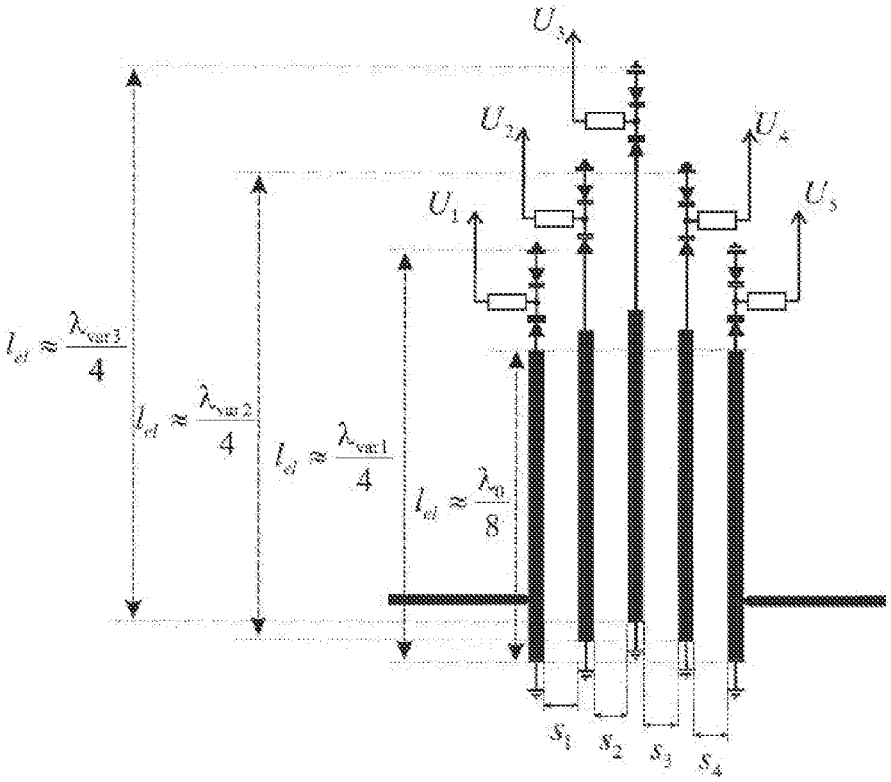
FIG. 1 is a functional block diagram of a combline filter fifth order according to a preferred embodiment of the present invention.
Figure 2:
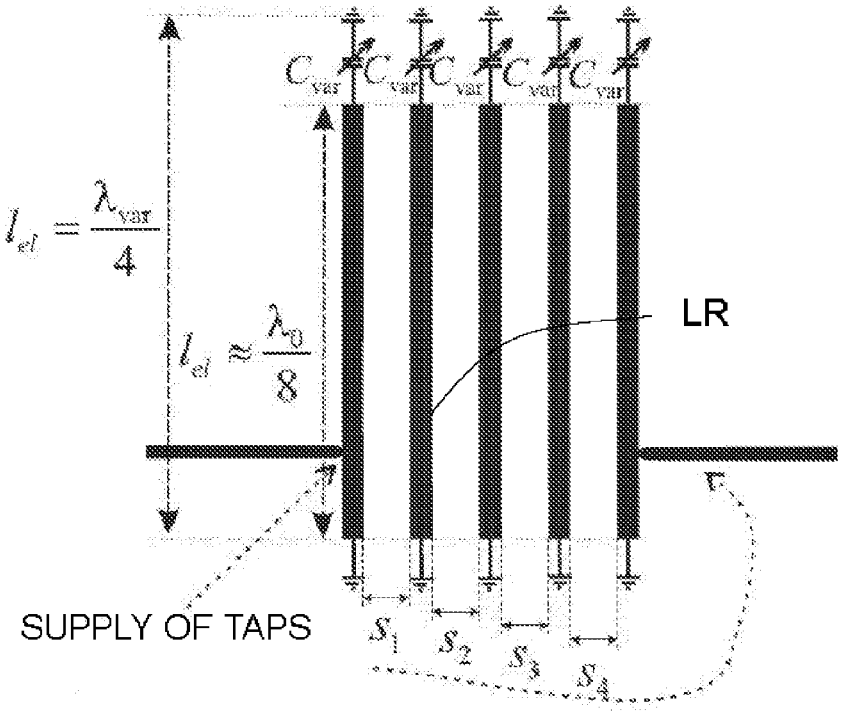
FIG. 2 (PRIOR ART)
FIG. 2 is a functional block diagram of a combline filter fifth order according to prior art.
Figure 3:
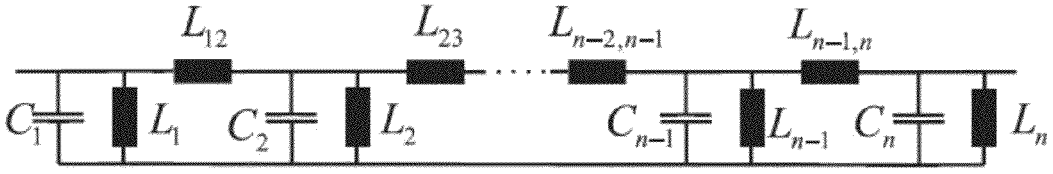
FIG. 3 is an equivalent circuit of a combline filter any order.

FIG. 1 shows a combline filter KF according to a preferred embodiment of the present invention which a modified combline filter is and known from literature, in the present case a combline filter fifth order whereas loaded line resonators LR are shifted against each other. The figure shows a preferred embodiment by shifting the loaded resonant lines in a triangular way. This way, a small tradeoff between the tuning range of the center frequency and the relative bandwidth is possible. Additionally it facilitates assembly of the capacitive loads arranged in form of a fan. This approach reduces the leakage capacitance between the SMD-housings said SMD-housings have a considerable influence to range and steep slopes of said filter KF.

As to control relative range a method is improved described by M. Sanchez-Renedo, R. Gomez-Garcia, J. Alonso, C. Briso-Rodriguez in "Tunable Combline Filter with Continuous Control of Center Frequency and Bandwidth," Microwave Theory and Techniques, IEEE Transactions on, vol. 53, pp. 191-199, 2005 for the application UHF band. The idea as published namely to introduce detuned resonators to reduce the bandwidth was adopted and expanded. As mechanically tunable capacitors were used there according to the invention an entirely electronic tuning was carried out thereby desired degree of freedom for the tuning could be better and simply realized. By this the bandwidth could be reduced by 50 percent and could be variable designed. varactor diodes V1, V2 are in anti-serial circuitry and the commonly used fixed capacitors can be abolished.

Furthermore in a preferred embodiment of the invention biasing voltage for tuning of the varactor diodes is conducted by a high ohmic resistor R instead of an inductor. This is possible as the very low reverse current through the varactor diode allows in comparison to prior art a more favorable realization and easier handling/component characteristic. For meeting the requirements a filter fifth order was chosen according to the embodiment shown in FIG. 1.

For optimization the circuitries the parameters are the individual length of each resonating line LR ($l_1$ to $l_5$), the distance between the lines S1 to S4 and the shift of the lines with respect to each other. Additionally the location of the taps can be altered.

Resonator lengths LR are initialized to λ/8 guided wavelength with respect to the geometric mean of the tuning range $$f_0=\sqrt{f_{min}\cdot f_{max}} \quad (1)$$

The dimension of the width of the resonant lines can be carried out as described by R. Trommer, "Entwicklung eines elektronisch durchstimmbaren Bandpassfilters von 900 bis 1300 MHz," Master's thesis, LHFT, Friedrich-Alexander Universität Erlangen-Nürnberg, 2009. The distances and shifts have an influence to insertion loss, tunable spectrum as well the relative bandwidth of said filter KF.

For narrow bandwidth, varactor diodes with high quality factor are necessary. The tuning range of its capacitance C should be determined by $$C_{var} = \frac{1}{Z\cdot 2\pi f_0\cdot \tan\theta_0} \quad (2)$$

within the calculated limits. Z represents the line impedance of the resonator, $f_0$ stands for its resonance frequency and $\theta_0$ is the according electrical length.

In this approach as varactor diode, especially V1 or V2, the diode BBY53 from Infineon is chosen, providing with 1.7 pF to 8 pF at 1.1 GHz a sufficient tuning range of the capacity. Beneath its acceptable quality factor of 40 to 70 (quality of line resonator in maximum is 200), this diode has the advantage of operating at relatively low block voltages ranging from 0 to 6V. This facilitates selective driving by using a multichannel D/A-converter. As substrate material Arlon AD 1000 is chosen, offering a relative dielectric constant of $\Sigma_r$=10 and a loss angle of tan δ=0.003 for this application.

Figure 4:
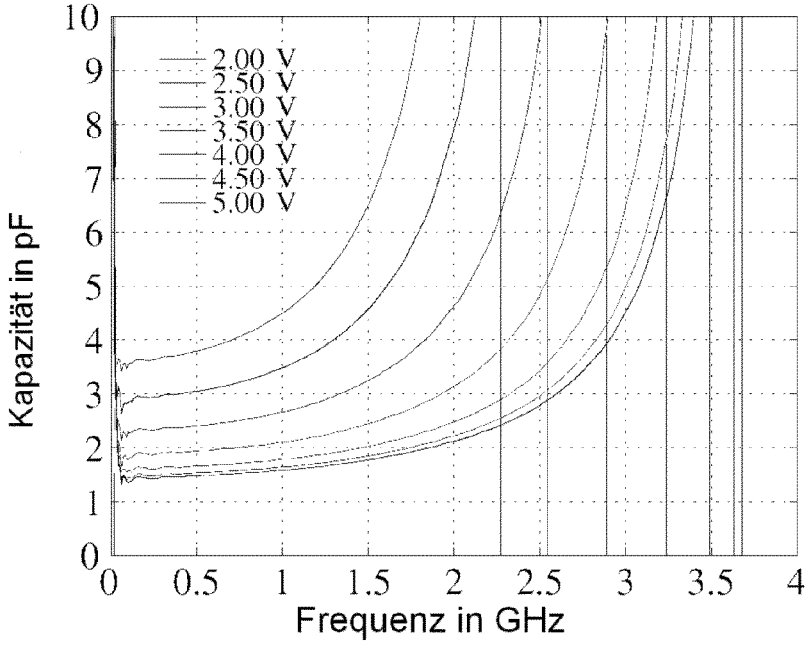
FIG. 4 is the capacity of a varactor diode over frequency at different bias voltages.
Figure 5:
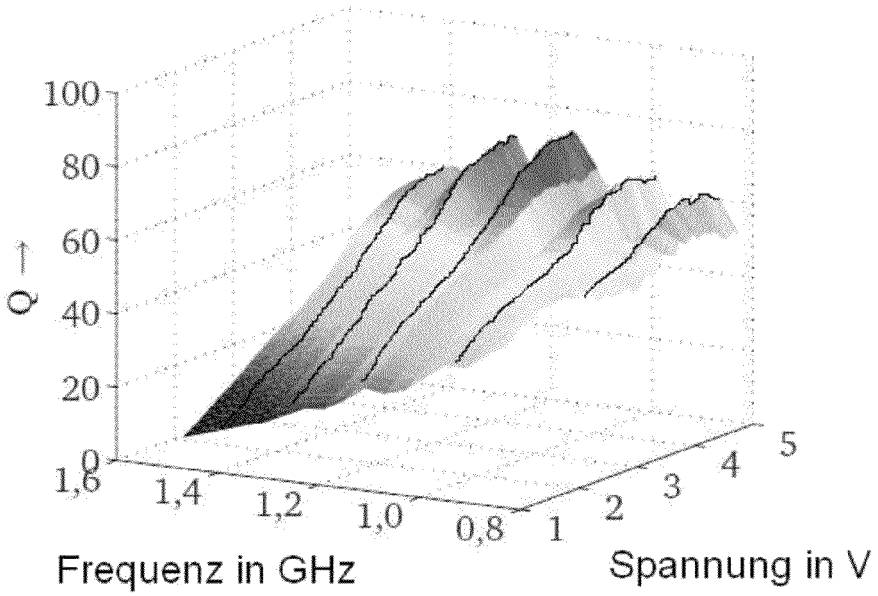
FIG. 5 is the quality of a varactor diode over frequency at different bias voltages.

The capacity of a varactor diode is a function of the frequency increasing to resonance. The reached quality depends less from tuning voltage but wholly from frequency used. For the example diode BBY 53 the results of measured capacity over used frequency are shown in FIG. 4. Beneath low tuning voltage the resonance frequency lies near to 2 GHz. This is near the upper border of the used frequency of said filter and can be a positively valued filter characteristic because of higher blocking attenuation.

Besides the capacity the quality of the diode BBY53 depends also from tuning voltage and frequency. The measurements results showed in FIG. 5 points out a quality of 40 to 70 in the frequency range between 800 MHz and 1300 MHz. For frequencies above the bandpass a significant reduced quality below 20 and a lower tuning voltage could be determined. For the bandpass this is irrelevant because the lower quality may be arises only in the stopband.

Using measured diode characteristics a numeral optimization of the combline structure by means of electromagnetic field lines could be done. For example the optimization can be done by generic algorithms. A difficult problem of field simulation is however that the effects of the diode housings couldn't be considered.

Figure 6:
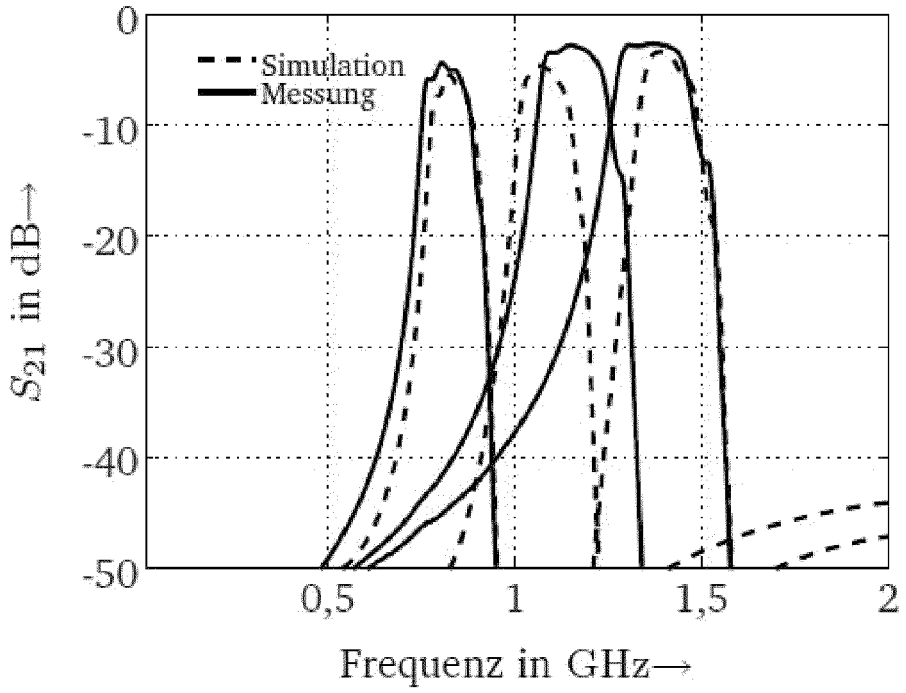
FIG. 6 is a measured transmission of a tuning range of said combline filter according to FIG. 1.

The arrangement of the diodes V in form of a fan according to the invention can reduce this effect but comparison of simulation and measurement shown in FIG. 6 points out that there is a strong influence by the leakage capacitance. A greater deviation of simulation and measurement can be seen at the upper range of the frequency used. The passband is broadened and the left filter slope is assumed less steep that could be an indicator as parasitic coupling capacity.

According to the invention for reducing the effect of parasitic coupling capacity unhoused diodes, especially for V1 or V2, are used whereas in an implementation example the values of a 3 dB bandwidth of the passband ranges from 115 MHz to 185 MHz corresponding to a relative bandwidth of 14%. During the measurement varactor diodes, especially V1 or V2, are all tuned to Ux=1 V for the lower passband (center frequency 800 MHz) and Ux=5 V for the upper passband (center frequency 1380 MHz) configuration. The insertion loss ranges from 2.8 dB to 4 dB.

Figure 7:
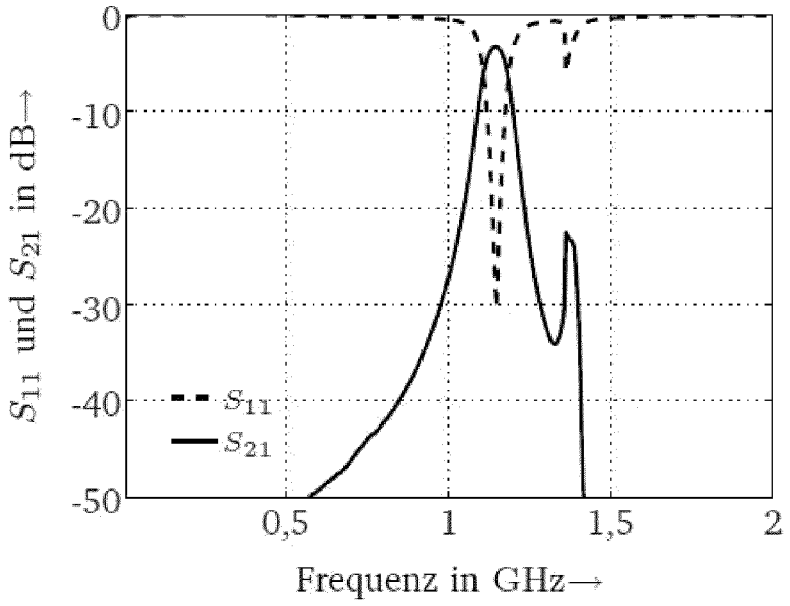
FIG. 7 is a measured S-parameter of said combline filter comprising detuned varactor diodes according to FIG. 1.
Figure 8:
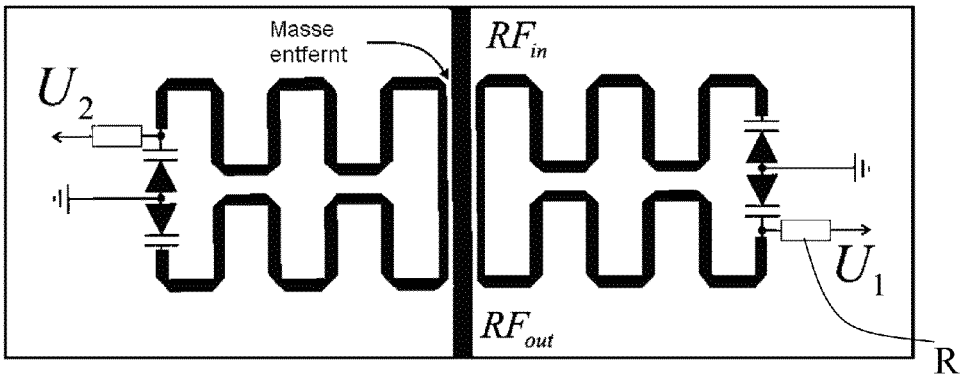
FIG. 8 is in accordance to the present invention an embodiment comprising two tunable notch filter coupled to the line, FIG. 9*a, b* is a comparison of electrical fields at the coupling slots

To reduce the bandwidth of the passband, according to the invention separate tuning voltage of each diode pair V1, V2 (this means detuning of individual line resonator) is applied. The experiment shows that a symmetric configuration of the voltage delivers the best results. FIG. 7 shows the measurement results of a configuration applying a center frequency of 1090 MHz and U1=3.0 V, U2=4.0 V, U3=2.8 V, U4=4.0 V, U5=3.0 V.

Thereby the resonator LR controlled by U2 and U4 could be detuned to higher frequency. This detuning of the resonator LR leads to a moderate damping of the upper part of the actual passband and to a significant reduced bandwidth. Thus the relative 3 dB bandwidth have been halved from 14% to 7% (equivalent to 76 MHz) but at the time the passband loss increases by 0.3 dB to now 3.3 dB. But it should be recognized that at 1400 MHz a further passband is generated but attenuated by 23 dB. Additionally it could be seen that the right filter slope having a similar reduced steepness as the left filter slope.

The measure of using symmetric voltage configuration for separate tuning voltages of each diode pair V1, V2 according to the invention has the advantage of a simple tuning algorithm due to less tuning voltages.

To increase the steepness of filter slopes, according to the invention tunable planar notch filters SK are used. Notch filters SK could absorb power in a clearly bordered bandwidth as is described by H. Ishida and K. Araki in "Coupled-Line Sharp Notch Filter with Significant Improvement of Attenuation," in Asia-Pacific Microwave Conference, 2006. By definition of the resonance frequency of a split ring resonator by electrical length these structures are suitable for capacitive loading by varactors thus the resonance frequency could be set electronically. The equivalent circuit of such a ring resonator is a simple parallel resonance circuit. As a rule the coupling to the transmission line is done capacitive.

The use of loaded split ring resonators is for example known by A. Genc and R. Baktur, "A tunable bandpass filter based on varactor loaded split-ring resonators," Microwave and Optical Technology Letters, vol. 51, pp. 2394-2396, 2009. In the frequency range of 800 MHz to 1300 MHz the use of such structure is problematic because of its size, as an electrical length equivalent to a full guided wavelength is needed. Significant size reduction is reached by using a folded structure like shown in FIG. 8 having a significant reduced area. Again, the varactor diodes V1, V2 are pairwise assembled in anti-serial circuitry and block voltage is offered through a high ohmic resistor R.

Besides quality capacitive coupling between notch circuit SK and transmission line is important. Coupling is thereby depending on length and width of the coupling slot between resonator and transmission line. A smaller slot means stronger coupling to the transmission line and power consumption at resonance frequency of the notch circuit SK, but is also harder to fabricate. Also using thin film technology slot width below 25 μm is a problem. To avoid costly production method coupling can be improved by a defected ground structure as this is described by R. Rehner, D. Schneiderbanger, M. Sterns, S. Martius, and L.-P. Schmidt, "Novel Coupled Microstrip Wideband Filters with Spurious Response Suppression," in EuMW, 2007.

Figure 9:
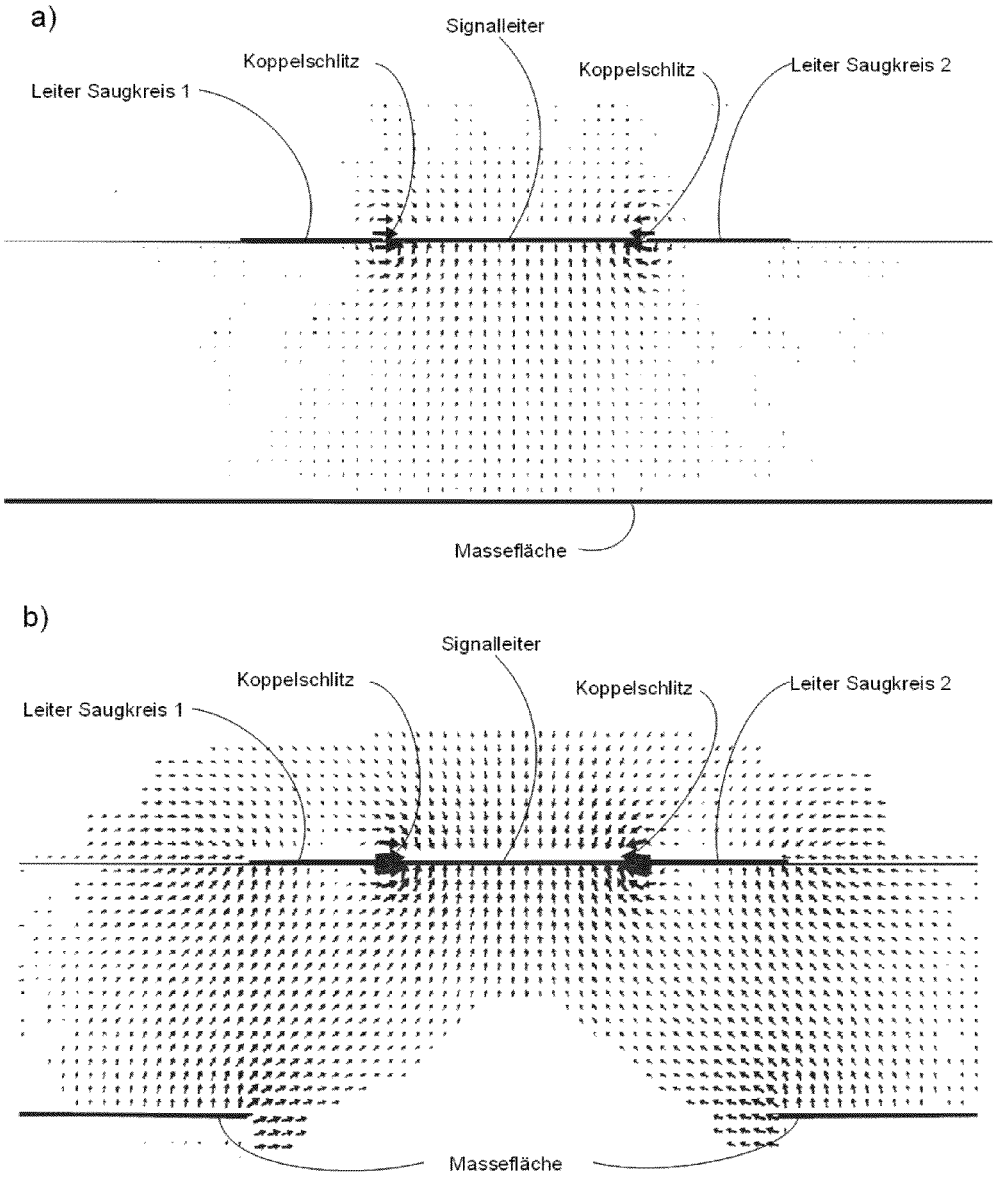
FIG. 9*a*: with and FIG. 9*b*: without partly defected ground.

Defecting the ground in the area below the coupling slots this concentrates the electrical field in the coupling slots thus sharper distinctable notches arise. This concentration of the electrical field could be shown by electromagnetic field simulation as shown in FIG. 9. A comparison to electrical field of a circuitry with ground shows a stronger concentration of the field in the coupling slots. The coupling improvement by 2-3 dB of said filter is reached by application of this technic.

Figure 10:
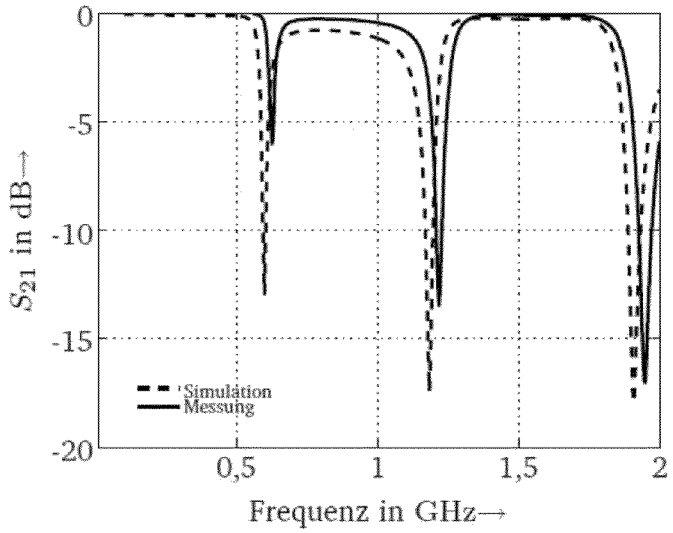
FIG. 10 is a diagram of the transmission characteristics of the circuit shown in FIG. 8 having an improved coupling by defected ground at the coupling slots.

A comparison of numerical results and measurements for a notch circuit SK is given in FIG. 10. The simulation shows slightly better stopband attenuation and resonances do not exactly match in frequency. A relatively good fit is reached to bandwidth of the resonances. Like anticipated, resonances are produced at integer multiples of the set fundamental frequency which are more distinct than the fundamental resonance. As the third resonance is stronger than the second resonance for application as notch circuit said notch circuit could be prolonged e.g. SK1, SK2 . . . and the third resonance is used. However the space of the structure must be enlarged so that the double fundamental resonance was chosen in the application.

Figure 11:
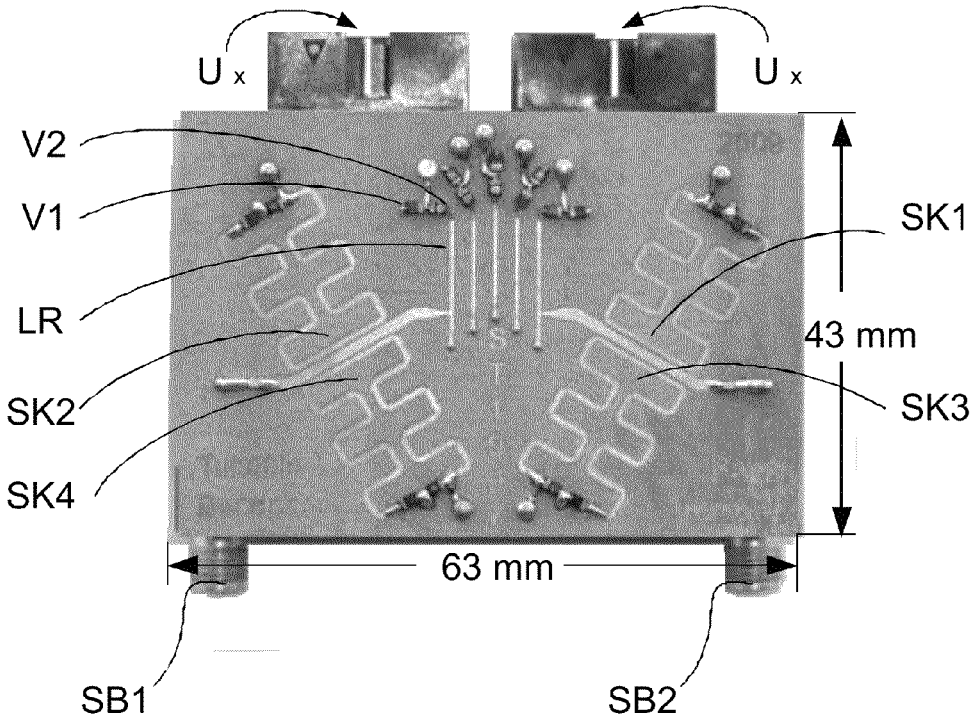
FIG. 11 is a circuit of a combline filter fifth order and four notch filter in accordance to the present invention.

To reach a low minimum bandwidth with steep flanks, according to the invention the reconfigurable bandpass filter on the basis of combline filter (for example fifth order) will be combined with a notch filter (the example shows four notch filters). The fabricated circuit is shown in FIG. 11. The structures are arranged in saving space. The input of tuning voltage Ux of the varactor diodes is carried out by an attached second board. The signal terminal of the filter is a coaxial socket SB1, SB2. For protection against oxidation all lines are gold-plated.

For measuring the transmission of a reconfigurable bandpass filter FI for reduction of bandwidth the tuning voltages for the combline filter are already detuned . . . . In the presented case the resonance frequency of the notch circuit SK1, SK2, that two notch resonances are chosen before and two right after the desired passband.

Figure 12:
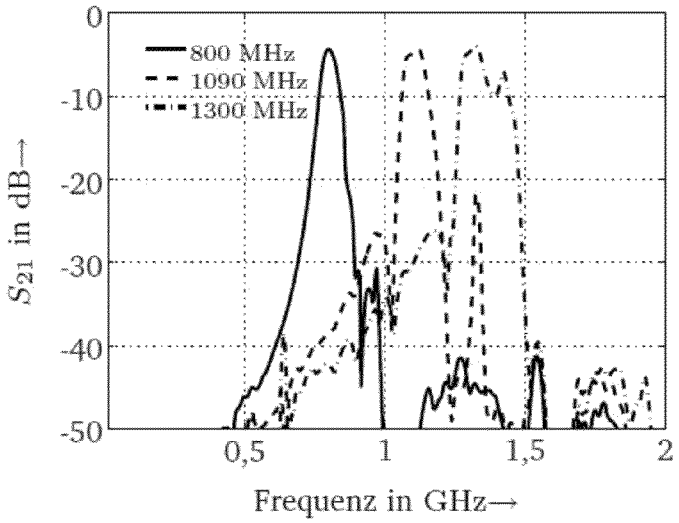
FIG. 12 is a measured transmission of a tuning range of said combline filter with notch filters according to FIG. 11.

FIG. 12 shows the measurement results of this configuration for three center frequencies (800 MHz, 1090 MHz and 1300 MHz). The measurement results at 800 MHz and 1090 MHz show significantly improved flanks. The calculated 3 dB-bandwidth remains almost unchanged, but the stopband attenuation for close interferers is due to scenario considerably improved. At 1300 MHz the tuning range of the notch filter is not sufficient to attenuate the right filter flank. Additionally, detuning of the combline's KF resonators is no longer possible because all varactor diodes V1, V2 are already driven close to their maximum block voltage. A drawback of the additional notch circuits e.eg. SK1, SK2 . . . is the added passband attenuation of 1 to 2 dB.

By suitable additional measures and modifications of a combline filter according to the invention the relative bandwidth is significant reduced. This can be achieved without sacrificing broadband tuning of the passband. The concept of detuning individual line resonator LR could be successfully used for reduction of the bandwidth. The use of additional notch circuits allows a flexible attenuation of interferers.

Figure 13:
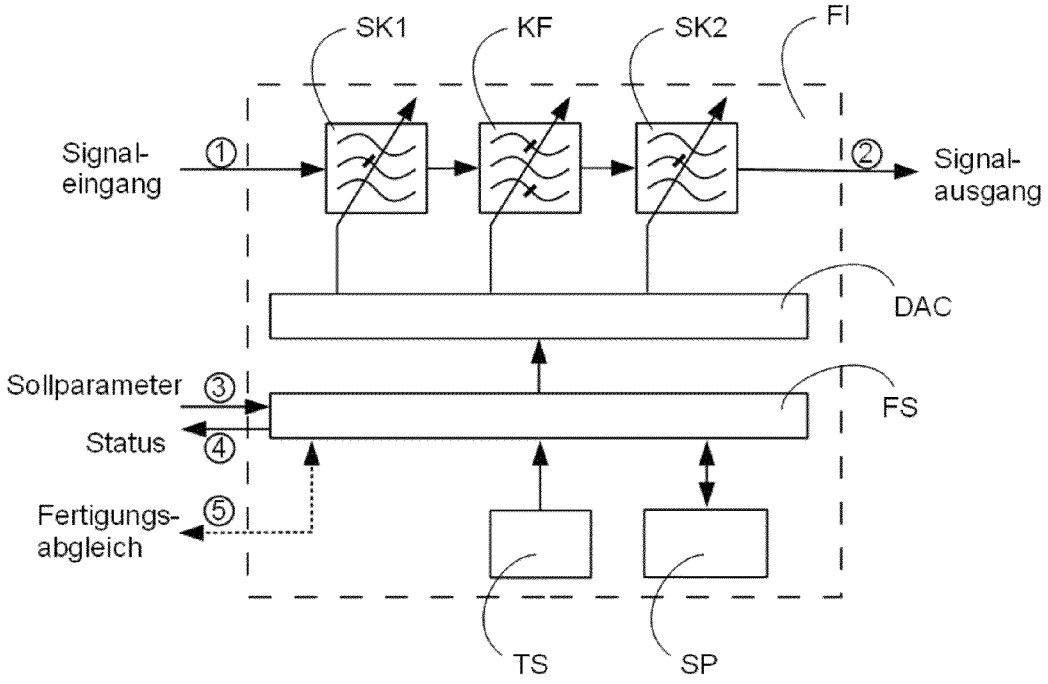
FIG. 13 is a functional block diagram of a preferred embodiment of an adjustable filter according to the present invention and FIG. 14 is a functional block diagram of an application of an adjustable filter according to the present invention.

The possibility of active response of said filter to actively react on a changed scenario by separate controlled tuning voltages and the integration of a microprocessor/microcomputer/filter control module FS (as shown in FIG. 13) permitting the filter concept in accordance with the invention very advantageous. Said microprocessor/microcomputer/filter control module FS makes an abstracted interface available. As suitable algorithm for the automatically calibration of the necessary setting of the tuning voltages is an optimization method like a gradient method, a generic algorithm or a method based on neural networks could be used. In this way the single tuning voltage must not be transferred but only the wanted filter parameters like center frequency of the passband, 3 dB-bandwidth, damping at a certain interfering frequency. Said filter FI automatically detects based on stored data (lookup table) the best configuration of tuning voltages to approximate the desired filter characteristic. The setting can be initial be done, especially by calibration at the plant and storing the values in a storage SP, for example an EPROM, and then adapted to temperature range and ageing during operation. For compliance with the temperature reference curves could be used determined by experiments in the climatic test cabinet. The calibration cannot only be done for the exit but also for a digital-analog-converter DAC because the available voltage also is dependent to temperature.

FIG. 13 shows a functional block diagram of a reconfigurable filter FI according to the present invention. In this example said filter FI is realized by a bandpass and two bandstop filter (notch filter e.g. SK1, SK2) these adjusted to the specific requirements by a filter control unit FS. The adjustment is done by digital-analog-converter DAC and, if necessary, by additional amplifiers to amplify the DAC-signal. The notch filters SK makes an exact tuning available as they generate a spectral sharp minimum of passband characteristic that passband characteristic could be exactly positioned by fine resolution of tuning voltages (generated by DAC for example with a resolution of 1024 levels). Said filter control module FS comprises interface for transferring specific parameters (3), issuing status information (4) as well for control and for exchange of information for manufacturing cross-checking (5). Furthermore connected to said filter control module FS is a temperature sensor TS as well as a memory SP for calibration data.

By actual temperature data and calibration data said filter control module FS is able for determining the necessary adjustments for the DA-converter DAC on basis of specific parameters. By means of status-exit for example the validity of parameters und the conclusion of an adjustment could be displayed. During production of said reconfigurable filter FI by means of external measurement devices the calibration data are determined and by means of interface are memorized in said filter for manufacturing cross-checking.

Figure 14:
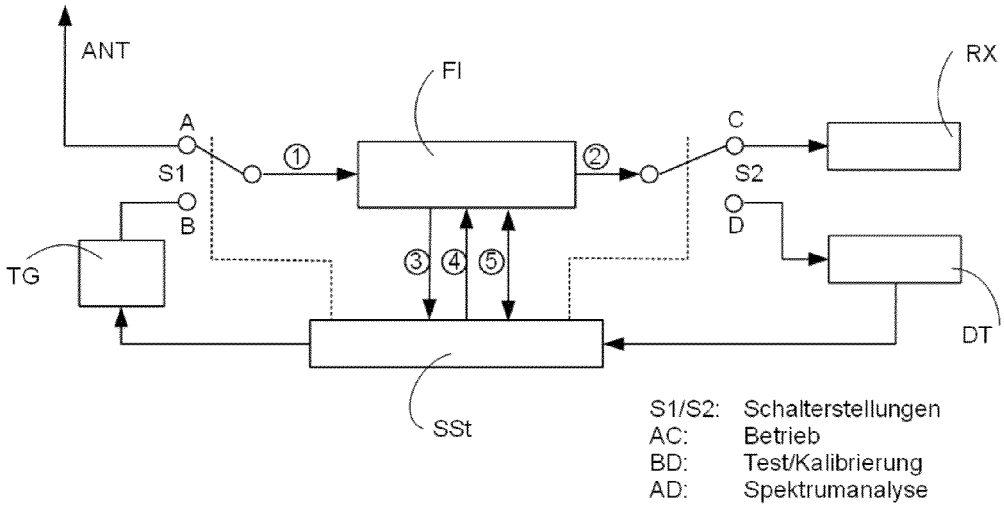

FIG. 14 shows a functional block diagram of an application of an adjustable filter in a system higher hierarchical order allowing besides normal operation also the verification and recalibration of said reconfigurable filter FI. The improved possibility of analyzing the spectrum as well the interference cancellation, especially the spectrum analyzing of the spectrum und adaptive configuration of the filter FI (combline filter KF and notch filter SK1, SK2, . . . ), can be used for interferer cancellation und for increasing the sensitivity of the receiving system. For measuring the filter characteristic the input of the filter FI could be connected by switch S1 either to an antenna signal ANT or to a test generator TG and the exit could be connected by a further switch S2 either to the receiver RX or to a detector DT. Controlling the verification and recalibration is done a central system control device SSt that using the available interfaces (3, 4 and 5; see FIG. 13) of said filter and by switches S1 and S2 makes the appropriate changes of the wiring. The switch position can be chosen depending on desired mode whereby operation (S1/S2=A/C), test and calibration (B/D) or spectral analysis are possible. The forgoing switch position (A/D) is used by the reconfigurable filter FI and allows a spectral analysis of the antenna signal ANT together with the detector DT, thus, as already described an analysis (sweep) of the whole interesting frequency range is possible in advantageous manner.

Further improvements by use of material offering a higher di electric constant are possible. The quality of the resonator LR could be increased as well the dimensions of the structures could be decreased. Additional for eliminating the parasitic coupling capacity unhoused varactor diodes V having a higher quality could be used.

Within the scope of the invention a self-calibration of the filter FI could be possible, especially for taking into account the ageing during operation. Thus the operating time could be counted (without storage) or the production date could be memorized in memory SP (for example EPROM). Furthermore there is the opportunity to use a test generator TG available in the system, which due to space isn't integrated in the filter. By means of a spectral tuning reference source the self-test of the filter in the system could be applied, whereby the necessary detector DT mustn't be available in the filter himself but in the system the filter is used. The test generator could be used for both verification and a simpler cross-checking (for example measuring of three points) what is simpler in comparison to a new calibration during operation.

Within the scope of the invention several filters KF and SK could be used by an overall filter (see FIG. 13: an example with three filters). By two combline filter lower order (for example three) in serial arrangement a lower passband could be achieved compared to a single combline filter higher order (an the same insertion loss). A possible explanation is the parasitic coupling of all available resonators LR of the filter KF. By two combline filter in serial arrangement the decoupling could be increased thereby increasing the quality. The two combline filter KF could be parameterized by a common microprocessor/microcomputer/filter control module FS (parameter for example target frequency, block frequency, bandwidth, insertion loss) such advantageously new possibilities for adjustment to the current situation (for example mobile mast) are available. Especially applied optimization is done by means of gradient methods. For adaptation the reception environment with regard to disturbing sources a desired filter curve could be generated by means of spectrum analysis. Using this chosen center frequency of bandpass filter and notch filter e.g. SK1, SK2 . . . could be determined and set. Furthermore an analysis (sweep) of the whole frequency range (tuning range) is possible as to find disturber. Whereas using only one combline filter KF this is saturated if needed and therefore said disturber couldn't be recognized using two filters KF shifted each another the disturber could be distinguishable.

The invention is not limited to the above embodiments and various modifications may be made without departing from the spirit and scope of the invention. Furthermore the invention is not restricted to the combination of feature of claim 1 but can be defined by any other combination of certain feature of all disclosed single features. This means any improvement may be made in part or all of the components.

The invention claimed is:

1. A reconfigurable bandpass filter comprising at least a tunable planar combline filter comprising unpackaged varactor diodes in pairs arranged like a fan on a carrier board, wherein for automatic calibration of adjustment of a separate tuning voltage for each pair of varactor diodes during operation said reconfigurable bandpass filter comprises a filter control offering an external interface, wherein a memory is connected with said filter control, wherein said memory stores calibration data, and wherein said filter control, for approximating of an optimal filter characteristic, determines based on a lookup table, an optimal configuration of the separate tuning voltage for each pair of varactor diodes, wherein said combline filter comprises loaded resonant lines shifted in a triangular way against another on said carrier board, and wherein said varactor diodes are arranged in antiserial circuitry, wherein for improvement of said filter characteristic, at least a tunable, planar absorption circuit connected with said filter control is coupled to a transmission line, wherein for coupling to said transmission line, small slots are present between said transmission line and said absorption circuit and notches at said small slots are provided in a metallization backside of said carrier board, wherein tuning of said varactor diodes is done completely electronically by supplying said separate tuning voltage to each pair of varactor diodes, and wherein said separate tuning voltage supplied to each pair of varactor diodes may be the same or different depending upon the optimal configuration in the lookup table.

2. The reconfigurable bandpass filter according to claim 1, wherein a high ohmic resistor is used to supply said separate tuning voltage to each pair of said varactor diodes.

3. The reconfigurable bandpass filter according to claim 1, wherein a temperature sensor is connected with said filter control.

* * * * *